US009779900B2

(12) United States Patent
Thomas

(10) Patent No.: US 9,779,900 B2
(45) Date of Patent: Oct. 3, 2017

(54) CIRCUIT BREAKER HEATER-BIMETAL ASSEMBLY, HEATER-BIMETAL APPARATUS, AND ASSEMBLY METHODS THEREOF

(75) Inventor: Stephen Scott Thomas, Atlanta, GA (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 538 days.

(21) Appl. No.: 14/366,727

(22) PCT Filed: Feb. 23, 2012

(86) PCT No.: PCT/US2012/026272

§ 371 (c)(1),
(2), (4) Date: Oct. 17, 2014

(87) PCT Pub. No.: WO2013/126059

PCT Pub. Date: Aug. 29, 2013

(65) Prior Publication Data

US 2015/0145636 A1 May 28, 2015

(51) Int. Cl.
*H01H 37/54* (2006.01)
*H01H 71/16* (2006.01)
(Continued)

(52) U.S. Cl.
CPC ..... *H01H 37/54* (2013.01); *H01H 11/00* (2013.01); *H01H 37/04* (2013.01);
(Continued)

(58) Field of Classification Search
CPC .... H01H 37/04; H01H 37/54; H01H 37/5427; H01H 71/162; H01H 71/164;
(Continued)

(56) References Cited

U.S. PATENT DOCUMENTS 3,116,388 A * 12/1963 Hobson, Jr. ..... H01H 83/20 335/173
3,155,795 A * 11/1964 Jencks ..... H01H 71/162 337/101

(Continued)

OTHER PUBLICATIONS

PCT International Search Report dated Nov. 16, 2012 corresponding to PCT International Application No. PCT/US2012/026272 filed Feb. 23, 2012 (9 pages).

(Continued)

*Primary Examiner* — Anatoly Vortman
*Assistant Examiner* — Jacob Crum

(57) ABSTRACT

A heater-bimetal apparatus is disclosed. The heater-bimetal apparatus has a heating element having a first portion and a second portion, a bimetal element coupled to the heating element at a third portion between the first and second portions, and a support member coupled to the heating element at the third portion, the support member including registration surfaces adapted to be received in pockets formed in spaced portions of circuit breaker housing. Assemblies including the heater-bimetal apparatus and methods of assembly of heater-bimetal assemblies are provided, as are other aspects.

20 Claims, 4 Drawing Sheets

(51) Int. Cl.
*H01H 11/00* (2006.01)
*H01H 37/04* (2006.01)
*H01H 37/52* (2006.01)

(52) U.S. Cl.
CPC ..... *H01H 71/164* (2013.01); *H01H 2037/525* (2013.01); *Y10T 29/49105* (2015.01)

(58) Field of Classification Search
CPC ..... H01H 71/325; H01H 71/40; H01H 2037/525; H01H 11/00
USPC ..... 337/112, 372, 380
See application file for complete search history.

(56) References Cited

U.S. PATENT DOCUMENTS

| | | | | |
|---|---|---|---|---|
| 3,162,739 | A | 12/1964 | Powell | |
| 3,264,435 | A * | 8/1966 | Klein | E04C 2/243 335/35 |
| 3,777,293 | A | 12/1973 | Tuzuki | |
| 6,335,674 | B1 * | 1/2002 | Huang | H01H 13/04 337/112 |
| 2009/0224864 | A1 * | 9/2009 | Tetik | H01H 71/16 337/372 |

OTHER PUBLICATIONS

Translation of Chinese Office Action dated Nov. 19, 2015 corresponding to Chinese Application No. 201280070614.6. filed Feb. 23, 2012. (23 pages).

* cited by examiner

FIG. 1A
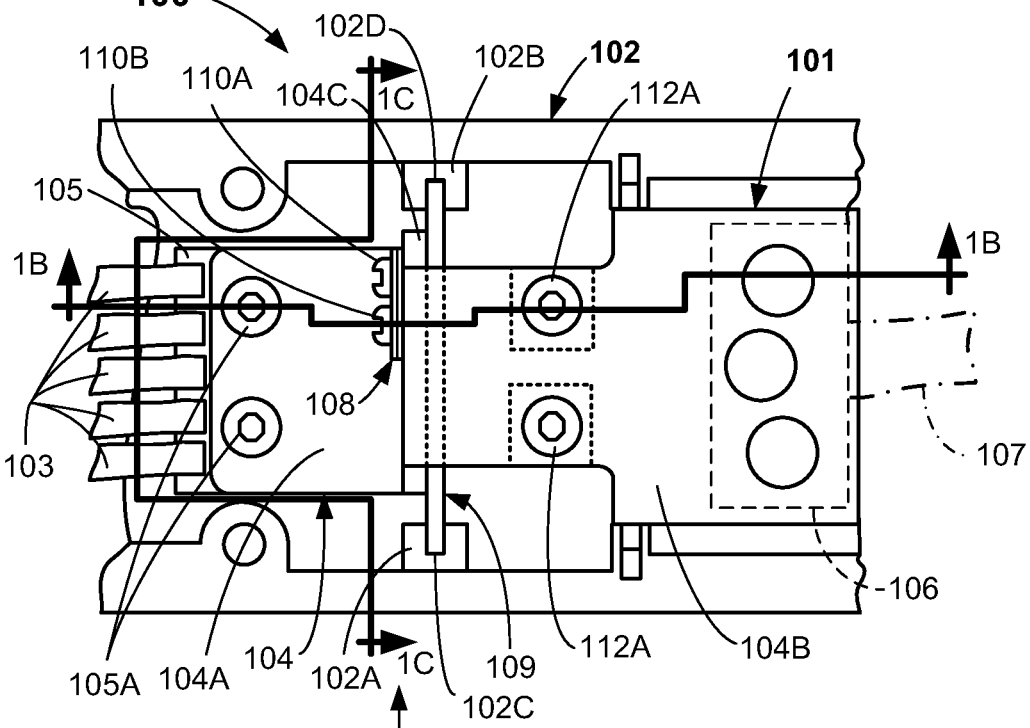
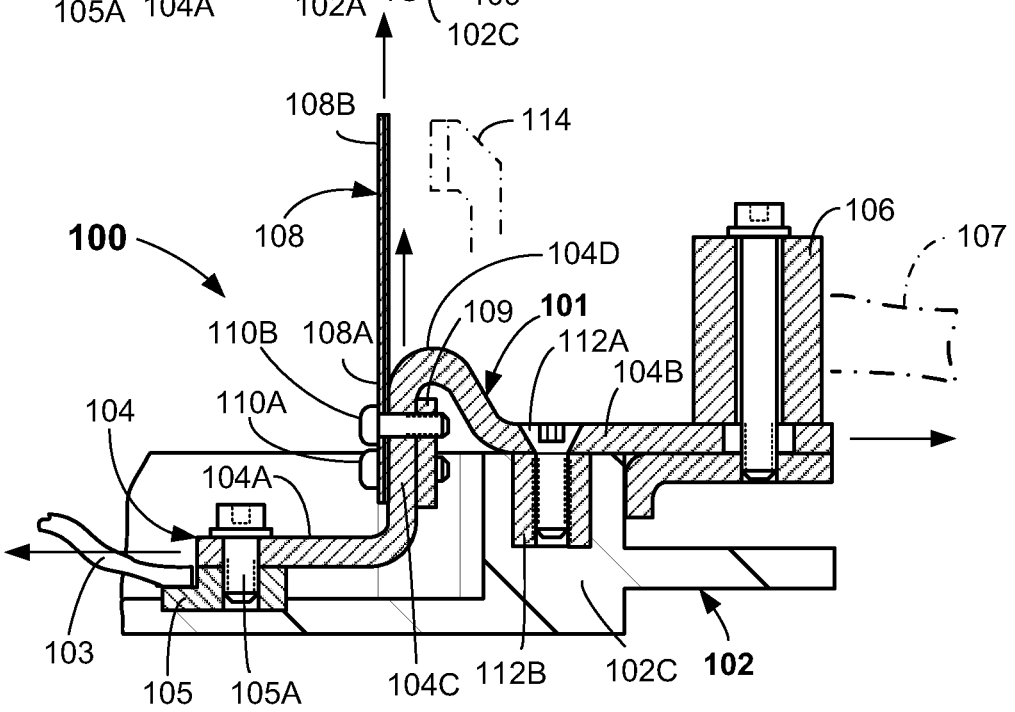
FIG. 1B

CIRCUIT BREAKER HEATER-BIMETAL ASSEMBLY, HEATER-BIMETAL APPARATUS, AND ASSEMBLY METHODS THEREOF

FIELD

The present invention relates generally to circuit breakers, and more particularly to heater-bimetal assemblies adapted to be used in circuit breakers.

BACKGROUND

Within circuit breakers, one or more moveable electrical contacts may be provided. Such electrical contacts, in some circuit breaker configurations, may be electrically coupled by one or more flexible conductors to a heater-bimetal assembly. The heater-bimetal assembly functions to trip the circuit breaker when a persistent over-current situation is encountered in the electrical circuit protected by the circuit breaker. Tripping involves resistive heating of a heating element, which, in turn, heats a bimetal element thereby causing bending of a bimetal element. Upon bending, the bimetal element makes engaging contact with a portion of a trip mechanism, and if sufficient heating is present will resultantly trip the circuit breaker. This opens the electrical contacts thereby opening the protected circuit.

However, existing heater-bimetal assembly designs can create inconsistencies in the performance of the circuit breaker.

SUMMARY

In a first aspect, a circuit breaker heater-bimetal apparatus is provided. The circuit breaker heater-bimetal apparatus includes a housing having a first housing portion and a second housing portion spaced from the first housing portion, a support member spanning between the first and second housing portions, a heating element coupled to the support member, the heating element having a first portion extending from the support member in a first direction, and a second portion extending from the support member in a second direction, and a bimetal element coupled to the heating element and extending from the heating element in a third direction.

In another aspect, a circuit breaker heater-bimetal assembly is provided. The circuit breaker heater-bimetal assembly includes a housing having a first housing portion with a first pocket and a second housing portion spaced from the first housing portion with a second pocket, a heating element having a first portion extending in a first direction and adapted to connect to one or more flexible conductors, and a second portion in a second direction and adapted to couple to one or more load conductors, a bimetal element coupled to a third portion of the heating element between the first portion and the second portion, the bimetal element extending from the heating element in a third direction, and a support member secured to the heating member at the third portion and spanning between the first housing portion and the second housing portion, the support member having ends that extend beyond a width of the heating element at the third portion and registration surfaces that are received in the first pocket and second pocket.

In an apparatus aspect, a heater-bimetal apparatus is provided. The heater-bimetal apparatus includes a heating element having a first portion extending in a first direction, and a second portion extending in a second direction, the first portion adapted to couple to one or more flexible conductors, the second portion adapted to couple to a load conductor, a bimetal element coupled to the heating element at a third portion between the first portion and the second portion, the bimetal element extending from the heating element in a third direction, and a support member coupled to the heating element, the support member including registration surfaces adapted to be received in pockets formed in a circuit breaker housing.

In a method aspect, a method of assembling a heater-bimetal assembly is provided. The method includes providing a circuit breaker housing having a first housing portion having a first pocket and a second housing portion spaced from the first housing portion, the second housing portion having a second pocket, providing a heater-bimetal apparatus having a heating element, the heating element having a first portion extending in a first direction, and a second portion extending a second direction, and a bimetal element coupled to the heating element and extending in a third direction, and a support member coupled to the heating element between the first portion and the second portion, the support member having registration surfaces, and receiving the registration surfaces of the support member in the first pocket and the second pocket.

Still other aspects, features, and advantages of the present invention may be readily apparent from the following detailed description by illustrating a number of exemplary embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

BRIEF DESCRIPTION OF DRAWINGS

FIG. 1A illustrates a top view of a heater-bimetal assembly according to embodiments.

FIG. 1B illustrates a partially cross-sectioned side view of a heater-bimetal assembly taken along section line 1B-1B of FIG. 1A.

DETAILED DESCRIPTION

Figure 1C:
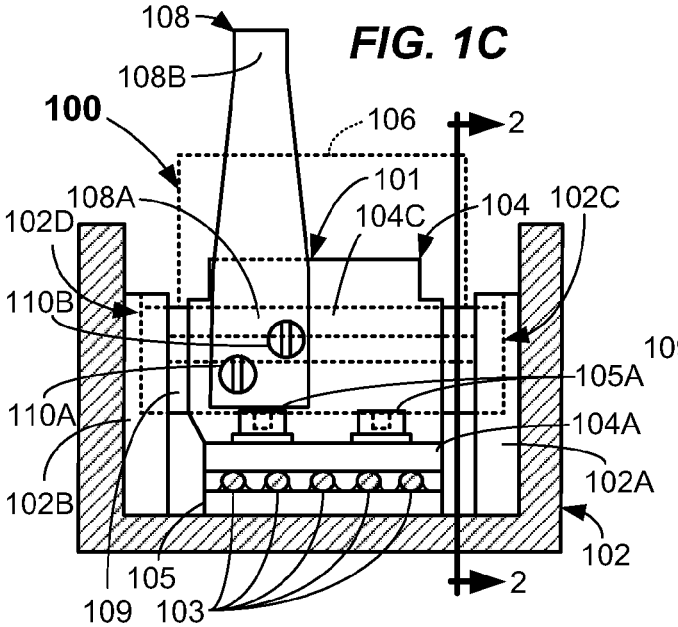
FIG. 1C illustrates a partially cross-sectioned frontal view of a heater-bimetal assembly taken along section line 1C-1C of FIG. 1A.

In existing heater-bimetal apparatus and assemblies, mounting of the heater-bimetal apparatus into the circuit breaker housing can cause misalignment of the heater-bimetal apparatus within the circuit breaker housing. Such misalignment can cause variances in the position of a bimetal element relative to a trip member of a tripping mechanism. As a result of such misalignment, calibration of the circuit breaker can become more difficult and variable. Furthermore, one or more embodiments may help prevent assembly of a damaged heater element or one that is not formed correctly. Also, embodiments may provide a more fool-proof connection into housing. Moreover, it is desired that the assembly of the circuit breaker components into the circuit breaker housing be entirely gravity assembled. That is, all components should drop vertically under the force of gravity into the circuit breaker housing, and all fasteners connecting the heater-bimetal apparatus to the circuit breaker housing should be assembled vertically, as well.

In view of the foregoing difficulties and desired assembly attributes, and, in particular, the desire to reduce calibration variances and provide improved assembly of the components, improved heater-bimetal apparatus and circuit breaker heater-bimetal assemblies are provided. The circuit breaker heater-bimetal assembly includes a circuit breaker housing having spaced first and second housing portions, a support member spanning between the first and second housing portions, a heating element coupled to the support member, and a bimetal element coupled to the heating element.

The heater-bimetal apparatus includes a heating element having a first portion adapted to couple to one or more flexible conductors and a second portion adapted to couple to one or more load conductors, a bimetal element coupled to the heating element at a third portion between the first and second portions, and a support member coupled to the heating element at the third portion, the support member including registration surfaces adapted to be received in pockets formed in the circuit breaker housing.

As will become apparent from the following, the structure of the heater-bimetal apparatus according to embodiments can advantageously provide improved positioning (i.e., more precise positioning) within the circuit breaker housing. Moreover, the structure of the heater-bimetal apparatus is well adapted to the use of gravity assembly techniques.

These and other embodiments of the heater-bimetal apparatus, circuit breaker heater-bimetal assemblies including one or more of the heater-bimetal apparatus and methods of assembly of circuit breaker heater-bimetal assemblies are described below with reference to FIGS. 1A-4. The drawings are not necessarily drawn to scale. Like reference numerals are use throughout to denote like elements.

Figure 3:
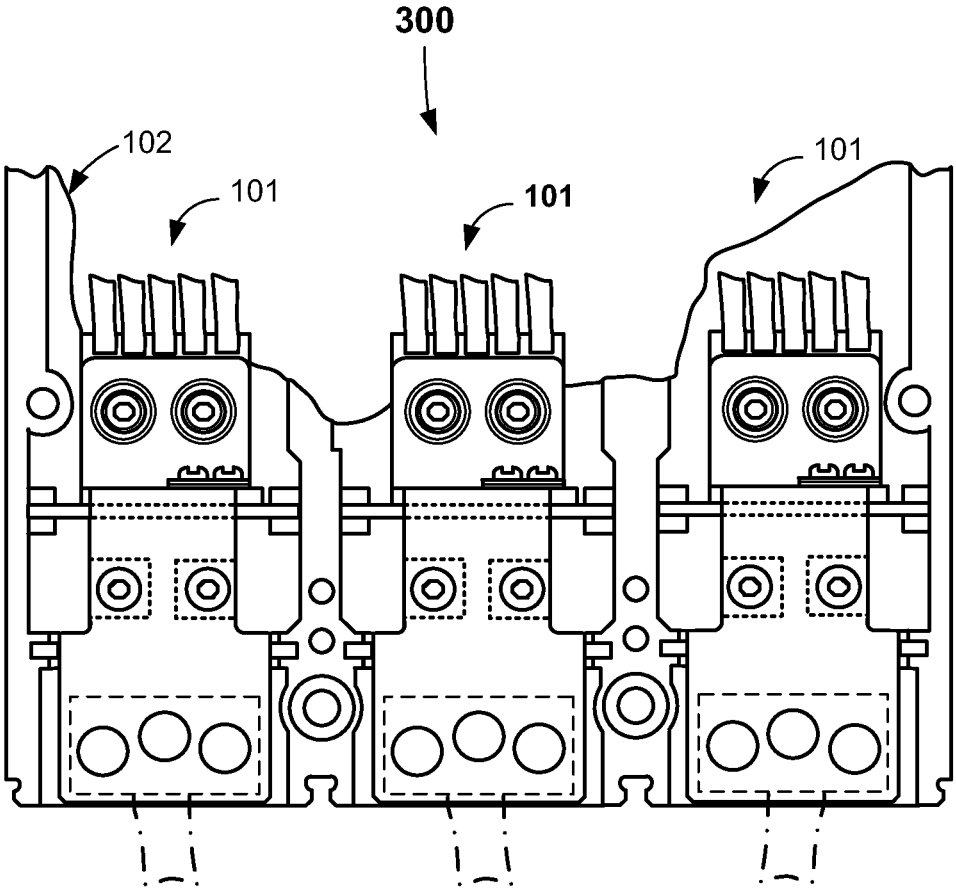
FIG. 3 illustrates a partial top view of multiple heater-bimetal apparatus received in a housing according to embodiments.

Referring now in specific detail to FIGS. 1A-1B, a circuit breaker heater-bimetal assembly 100 is shown. The circuit breaker heater-bimetal assembly 100 will be referred to herein as a "circuit breaker heater-bimetal assembly" or just "heater-bimetal assembly." The heater-bimetal assembly 100 may be made up of one or more heater-bimetal apparatus 101 installed within a housing 102 of a circuit breaker, as shown in FIGS. 1A-1B, for example. The circuit breaker may include one or more heater-bimetal apparatus 101. For example, a single heater-bimetal apparatus 101 may be provided for each electrical pole of the circuit breaker. For example, a three-pole circuit breaker may include three heater-bimetal apparatus 101, such as shown in FIG. 3.

Each heater-bimetal apparatus 101 may be interconnected to one or more contact fingers or arms of an electrical contact assembly (not shown) via one or more electrical conductors 103, such as braided copper cables. In some embodiments, one or more flexible electrical conductors 103 are configured and adapted to be connected to a first portion 104A of a heating element 104 that extends in a first direction, such as by braising. Other means for connection may be employed. For example, the flexible electrical conductors 103 may be braided copper lines and may be connected (e.g., by soldering, brazing or the like) to a connecting element 105, which is then connected to the heating element 104 by one or more fasteners 105A such as bolts, screws or the like. The connecting element 105 may be manufactured from any suitable electrically-conductive material, such as copper or steel. The connecting element 105 may be threaded to receive one or more fasteners 105A.

A second portion 104B of the heating element 104 extends in a second direction and is adapted to electrically couple to one or more load conductors 106. Load conductor 106 in the depicted embodiment may be a lug (Shown dotted in FIGS. 1A and 1C) attached to a load line 107. However, any suitable coupling means for connecting an electrical load line 107 to the heater-bimetal apparatus 101 may be used. Other types of connections include crimp connectors, bus bars, and the like.

Located between the first portion 104A and the second portion 104B, a third portion 104C of the heating element 104 may be provided. The third portion 104C may extend in a third direction, and may be planar. In one or more embodiments, the first portion 104A and the second portion 104B may be planar. The first portion 104A and the second portion 104B may be provided on different planes in some embodiments. The different planes may be parallel planes, for example. The plane of the first portion 104A may be lower than the plane of the second portion 104B. The third portion 104C may extend generally perpendicularly from the plane of the first portion 104A (i.e., at approximately 90 degrees from the first portion 104A). A bent portion 104D may be provided as a transition from the plane of third portion 104C to the plane of the second portion 104B. A narrowed portion 104E may be provided on the second portion 104B adjacent to the third portion 104C. A narrower width of the narrowed portion 104E may provide enhanced resistive heating.

Coupled to the heating element 104 at the third portion 104C is a bimetal element 108. The term "bimetal element" as used herein comprises an element having the ability and function to displace (e.g., bend) as exposed to changes in temperature. "Bimetal element" may include those having two or more dissimilar metals, such as steel and copper, or in some cases steel and brass. Other dissimilar metals may be used. The bimetal element 108 may be formed of strips that are joined together throughout their length by riveting, braising, or welding, or the like. The different expansion coefficients cause the joined strips to bend one way if heated, and return in the opposite direction when cooled. The metal with the higher coefficient of thermal expansion is provided on the outer side of the curve when the bimetal element 108 is heated.

The bimetal element 108 may be coupled to the heating element 104 at the third portion 104C and may extend in a third direction, which may be generally perpendicular from the plane of the first portion 104A of the heating element 104. The bimetal element 108 may be offset laterally from a longitudinal center of the heating element 104 as shown in FIG. 1C, and may include a tapered shape. The bimetal element 108 may taper from being relatively larger in width at the base 108A where the bimetal element 108 is attached to the heating element 104 to relatively smaller in width at a free end 108B. The bimetal element 108 may be between about 50 mm and 70 mm in length, between about 15 and 20 mm in width at the base 108A, and between about 5 and 10 mm in width at the free end 108B, for example. Other dimensions may be used.

Figure 2:
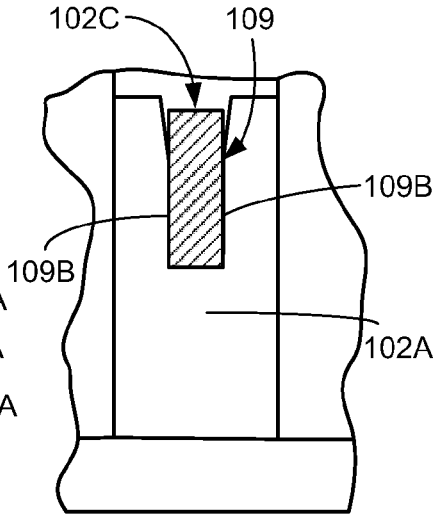
FIG. 2 illustrates a partial side view of a support member received in a pocket of a housing according to embodiments.
Figure 1F:
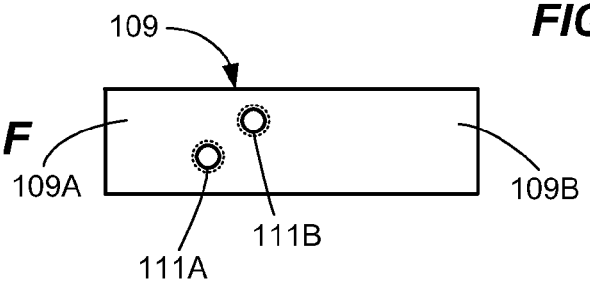
FIG. 1F illustrates a frontal view of a support member according to embodiments.
Figure 1D:
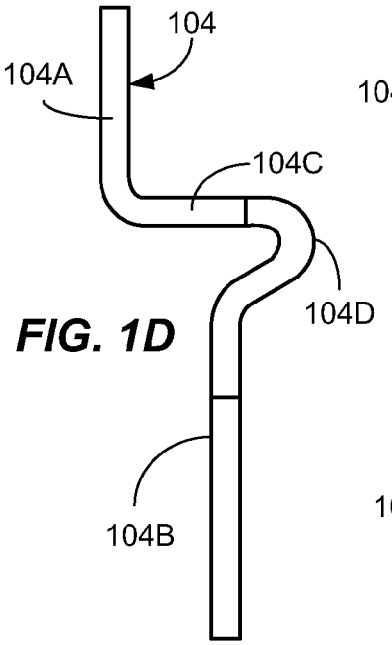
FIG. 1D illustrates a side view of a heating element according to embodiments.
Figure 1E:
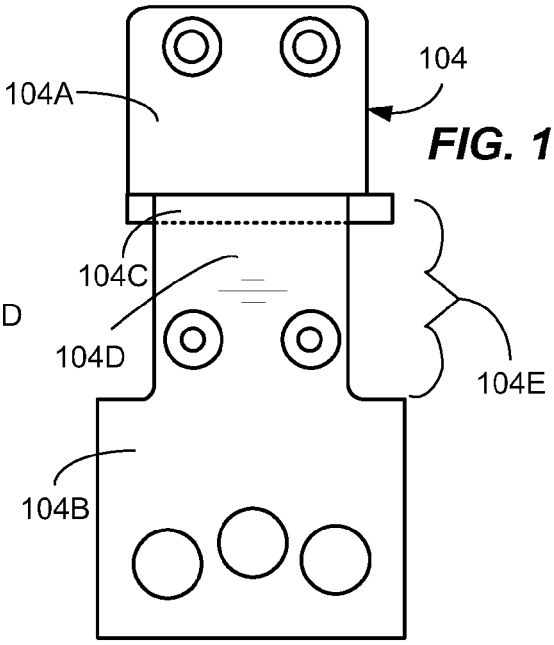
FIG. 1E illustrates a top view of a heating element according to embodiments.

Coupled to the heating element 104 at the third portion 104C is a support member 109. As shown in FIG. 2, the support member 109 may include registration surfaces 109A, 109B provided on each end that are adapted to be received into pockets 102C, 102D formed in the circuit breaker housing 102. The pockets 102C, 102D may include suitably tapered sides to enable ease of assembly and secure and precise location of the support member 109 in the housing. As installed, the fit of the ends of the support member 109 in the pockets 102C, 102D should be snug, with possible a slight press fit.

In the depicted embodiment, the support member 109 may comprise a bar such as a flat plate, and may include one or more threaded holes 111A, 111B. The support member 109 may be manufactured from a steel material. Other suitable materials may be used. The support member 109 may have a length of between about 40 mm and about 50 mm, a height of between about 10 mm and about 15 mm, and a thickness of between about 2 mm and about 3 mm. Other dimensions may be used. In one or more embodiments, the ends including the registration surfaces 109A, 109B extend beyond a maximum width of the heating element 104 at the attachment point (e.g., at the third portion 104C). In the depicted embodiment, the bimetal element 108 may be attached to the third portion 104C by fasteners 110A, 110B that may be received through holes formed in the heating element 104 and secured in threaded holes 111A, 111B in the support member 109 (See FIG. 1F).

As shown in FIG. 1A-1B, the heating element 104 may be coupled to the housing 102 at a base portion 102C of the circuit breaker housing 102. Base portion 102C may have one or more lugs (e.g., bosses, or risers) extending from a base of the housing 102. For example, fasteners 112A having a tapered underside on their heads, such as a flat-head socket-head cap screw or other the like tapered-head screws or bolts, may be received through tapered holes in the heating element 104 of the second portion 104B and secured in captured threaded elements 112B molded or otherwise received into the housing 102 (e.g., in the lugs). The heating element 104 may be secured to the base of the housing 102 at any suitable location on the second portion 104B, such as at the narrowed portion 104E.

FIG. 3 illustrates a partial top view of a multi-heater-bimetal assembly 300 may be made up of multiple heater-bimetal apparatus 101 installed within a circuit breaker housing 102 of a circuit breaker. Any suitable number of heater-bimetal apparatus 101 may be included in the assembly 300, such as two for a two-pole breaker, three for a three-pole breaker, four for a four-pole breaker (three-pole with (N) phase), and the like.

Figure 4:
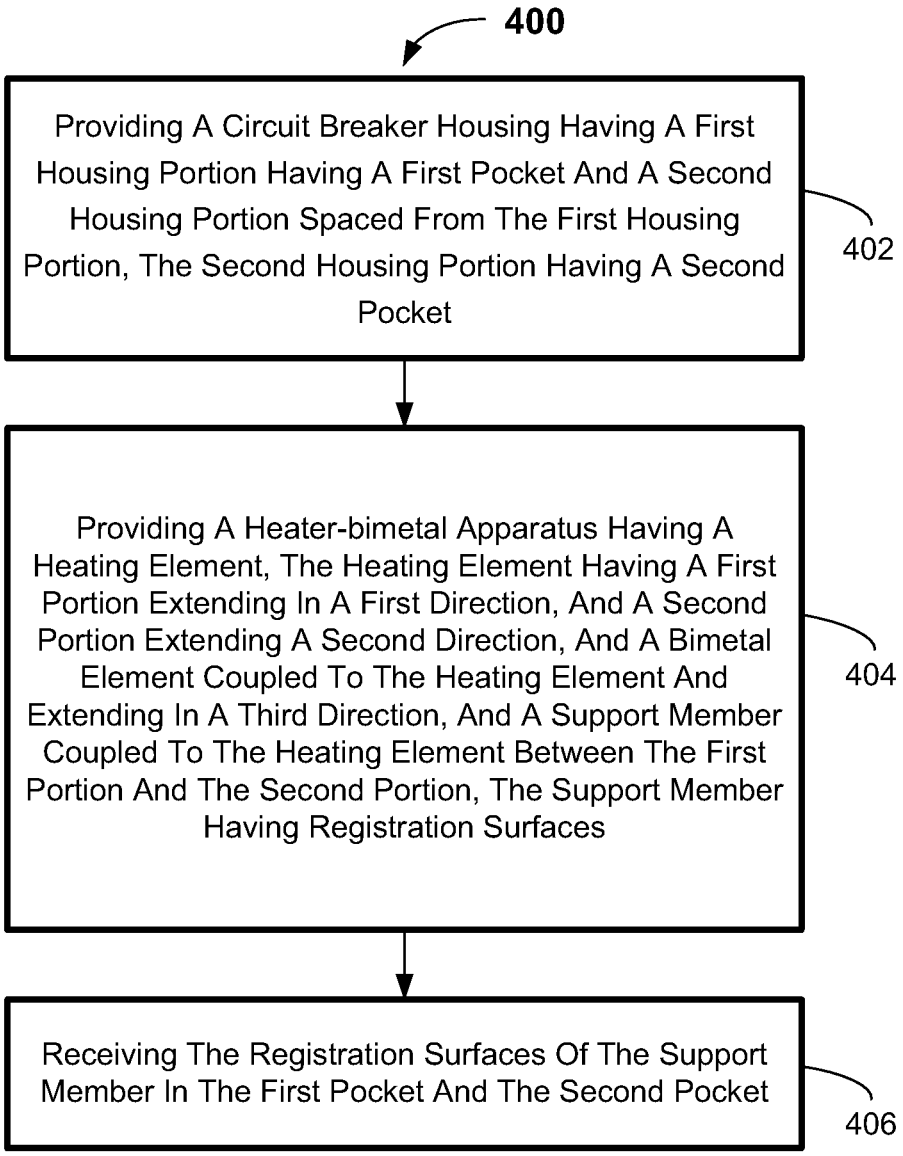
FIG. 4 is a flowchart illustrating a method of assembly of the heater-bimetal assembly according to embodiments.

FIG. 4 illustrates a flowchart of a method of assembling a heater-bimetal assembly according to embodiments. The method 400 includes, in 402, providing a circuit breaker housing (e.g., housing 102) having a first housing portion (e.g., first housing portion 102A) having a first pocket 102C and a second housing portion (e.g., second housing portion 102B) spaced from the first housing portion, the second housing portion having a second pocket (e.g., second pocket 102D). In 404, a heater-bimetal apparatus (e.g., heater-bimetal apparatus 101) is provided. The heater-bimetal apparatus 101 has a heating element (e.g., heating element 104), the heating element having a first portion (e.g., first portion 104A) extending in a first direction, and a second portion (e.g., second portion 104B) extending a second direction, and a bimetal element (e.g., bimetal element 108) coupled to the heating element and extending in a third direction, and a support member (e.g., support member 109) coupled to the heating element between the first portion and the second portion (e.g., at a third portion 104C), the support member having registration surfaces (e.g., registration surfaces 109A, 109B). In 406, the registration surfaces of the support member are received in the first pocket and the second pocket.

The heater-bimetal apparatus 101 may be attached to the housing 102 at another location, such as at the narrowed portion 104E of the second portion 104B, as discussed above. Other suitable secondary attachment locations on the heating element 104 may be used. Together, the connection of the bimetal-heater apparatus 101 to the housing 102 at the first and second housing portions 102A, 102B and elsewhere on the heating element 104 may provide a very stable and repeatable gravity-assisted installation. Accordingly, very accurate positioning of the bimetal element 108 adjacent to a trip member 114 (FIG. 1A) of a tripping mechanism of the circuit breaker may be provided.

While the invention is susceptible to various modifications and alternate forms, specific embodiments and methods have been shown by way of example in the drawings and are described in detail herein. It should be understood, however, that it is not intended to limit the invention to the particular apparatus, systems, or methods disclosed, but, to the contrary, the intention is to cover all modifications, equivalents and alternatives falling within the scope of the invention.

What is claimed is:

1. A circuit breaker heater-bimetal assembly, comprising:

a housing having a first housing portion including first guide features and a second housing portion spaced from the first housing portion, the second housing portion including second guide features;

a plate spanning between the first and second housing portions, the plate having first and second free ends;

a heating element coupled to the plate, the heating element having a first portion extending from the plate in a first direction, a second portion extending from the plate in a second direction, and a third portion between the first portion and the second portion; and a bimetal element coupled to the heating element and extending from the heating element in a third direction, wherein the third portion of the heating element extends in the third direction, wherein the heating element is sandwiched between the bimetal element and the plate such that the bimetal element is attached to the third portion by fasteners that are received through holes formed in the bimetal element and holes formed in the heating element and secured in threaded holes in the plate, and wherein the first and second free ends of the plate along with the first and second guide features assist in gravity-based vertical locating of the circuit breaker heater-bimetal assembly to a desired position into the housing.

2. The heater-bimetal assembly of claim 1, wherein the first portion of the heating element comprises a planar surface coupling the heating element to one or more flexible conductors.

3. The heater-bimetal assembly of claim 1, wherein the heating element is coupled to the plate at the third portion.

4. The heater-bimetal assembly of claim 1, wherein the second portion of the heating element is secured to a base portion of the housing.

5. The heater-bimetal assembly of claim 4, wherein the second portion of the heating element is secured to one or more lugs formed in the base portion of the housing.

6. The heater-bimetal assembly of claim 5, wherein the heating element is secured to the one or more lugs of the housing by flat-head screws having tapered heads received in tapered holes in the heating element.

7. The heater-bimetal assembly of claim 1, wherein the plate comprises a bar having ends that extend beyond a width of the heating element at a third portion located between the first portion and the second portion.

8. The heater-bimetal assembly of claim 1, comprising:

a first pocket formed in the first housing portion as the first guide features, and a second pocket formed in the second housing portion as the second guide features.

9. The heater-bimetal assembly of claim 8, comprising:

tapered sides formed in the first pocket and the second pocket.

10. The heater-bimetal assembly of claim 8, wherein the plate is received in the first pocket and the second pocket.

11. The heater-bimetal assembly of claim 8, wherein the plate has the first and second free ends that extend beyond a width of the heating element at a third portion between the first portion and the second portion and wherein the plate has registration surfaces that are received in the first pocket and the second pocket.

12. A method of assembling a heater-bimetal assembly, comprising:

providing a housing having a first housing portion including first guide features and a second housing portion spaced from the first housing portion, the second housing portion including second guide features;

providing a plate spanning between the first and second housing portions, the plate having first and second free ends;

providing a heating element coupled to the plate, the heating element having a first portion extending from the plate in a first direction, a second portion extending from the plate in a second direction, and a third portion between the first portion and the second portion; and providing a bimetal element coupled to the heating element and extending from the heating element in a third direction, wherein the third portion of the heating element extends in the third direction, wherein the heating element is sandwiched between the bimetal element and the plate such that the bimetal element is attached to the third portion by fasteners that are received through holes formed in the bimetal element and holes formed in the heating element and secured in threaded holes in the plate, and wherein the first and second free ends of the plate along with the first and second guide features assist in gravity-based vertical locating of the circuit breaker heater-bimetal assembly to a desired position into the housing.

13. The method of claim 12, wherein the first portion of the heating element comprises a planar surface coupling the heating element to one or more flexible conductors.

14. The method of claim 12, wherein the heating element is coupled to the plate at the third portion.

15. The method of claim 12, wherein the second portion of the heating element is secured to a base portion of the housing.

16. The method of claim 15, wherein the second portion of the heating element is secured to one or more lugs formed in the base portion of the housing.

17. The method of claim 16, wherein the heating element is secured to the one or more lugs of the housing by flat-head screws having tapered heads received in tapered holes in the heating element.

18. The method of claim 12, wherein the plate comprises a bar having ends that extend beyond a width of the heating element at a third portion located between the first portion and the second portion.

19. The method of claim 12, wherein the heater-bimetal assembly comprising:

a first pocket formed in the first housing portion as the first guide features, and a second pocket formed in the second housing portion as the second guide features.

20. The method of claim 19, wherein the heater-bimetal assembly comprising:

tapered sides formed in the first pocket and the second pocket.

* * * * *